US007410432B2

(12) United States Patent
Dehen

(10) Patent No.: US 7,410,432 B2
(45) **Date of Patent: *Aug. 12, 2008**

(54) HOCKEY STICK

(76) Inventor: Martin L Dehen, 4170 Orchid La., Plymouth, MN (US) 55446

( * ) Notice: Subject to any disclaimer, the term of this patent is extended or adjusted under 35 U.S.C. 154(b) by 0 days.

This patent is subject to a terminal disclaimer.

(21) Appl. No.: 11/499,233

(22) Filed: Aug. 3, 2006

(65) Prior Publication Data

US 2006/0270497 A1 Nov. 30, 2006

Related U.S. Application Data

(60) Division of application No. 11/173,476, filed on Jun. 30, 2005, now abandoned, which is a continuation of application No. 10/700,090, filed on Nov. 3, 2003, now Pat. No. 6,926,629.

(60) Provisional application No. 60/423,436, filed on Nov. 4, 2002.

(51) Int. Cl.
*A63B 59/14* (2006.01)

(52) U.S. Cl. ..... 473/563; 473/560; 119/867

(58) Field of Classification Search ..... 473/560–563, 473/236, 235, 328, 228, 242, 518–520, 594, 473/446, 437; 172/371; 119/867
See application file for complete search history.

(56) References Cited

U.S. PATENT DOCUMENTS

| | | | | |
|---|---|---|---|---|
| 1,464,029 | A | 8/1923 | Coughtrie | |
| 2,057,821 | A | 10/1936 | Costello | |
| 2,094,766 | A | 10/1937 | Costello | |
| 3,516,668 | A | 6/1970 | Kirk | |
| 3,561,760 | A | 2/1971 | Kiay | |
| 3,565,444 | A | 2/1971 | La Rocca | |
| 4,653,753 | A | 3/1987 | Scarry | |
| 5,011,153 | A | 4/1991 | Watkins | |
| 5,062,639 | A | 11/1991 | Hitt | |
| 5,135,228 | A | 8/1992 | Hawkins et al. | |
| 5,335,918 | A | 8/1994 | Rupnik et al. | |
| 5,441,268 | A | 8/1995 | Shier | |
| 5,470,067 | A | 11/1995 | Diresta | |
| 5,484,146 | A | 1/1996 | Loschiavo | |
| 5,520,386 | A | 5/1996 | Sasko | |
| 5,609,336 | A * | 3/1997 | Tashjian | 473/560 |
| 5,620,377 | A | 4/1997 | Glockner | |
| 5,810,675 | A | 9/1998 | Weathers | |
| 5,816,945 | A | 10/1998 | Todd et al. | |
| 5,816,962 | A | 10/1998 | Etersque | |
| 5,893,811 | A | 4/1999 | Stover et al. | |
| 5,924,935 | A | 7/1999 | Prewitt | |

(Continued)

FOREIGN PATENT DOCUMENTS

| | | |
|---|---|---|
| CA | 936553 | 11/1973 |

*Primary Examiner*—Mark S Graham

(57) ABSTRACT

An attachment for a blade of a playing stick such as a hockey stick. The attachment includes a floor portion with a leading edge that digs under an object to be flung by the stick. The attachment includes a base portion that engages the blade. The floor portion may be flexed between an L-shaped position and a V-shaped position, relative to the base portion or blade. The attachment may include a finger for engaging the heel end of the blade, ceiling portion, a seat on the floor portion, an undulating leading edge, a slot for being engaged by a tether that wraps about the blade, and a base portion that is curved for a curved blade.

6 Claims, 9 Drawing Sheets

U.S. PATENT DOCUMENTS 6,174,248 B1 1/2001 Lawlor et al.
6,224,505 B1 5/2001 Burger
6,273,835 B1 8/2001 Battis et al.
6,383,098 B1 5/2002 Haumschilt et al.
6,464,596 B1 10/2002 Belding
6,533,043 B1 3/2003 Duyck et al.
6,626,775 B2 9/2003 Tiitola
6,702,688 B2 3/2004 Hale
6,926,629 B2 * 8/2005 Dehen ..... 473/563
2004/0137997 A1 7/2004 Rohrer

* cited by examiner 22
10
30
24
76
4A
34
28
26
78
32
4A

HOCKEY STICK

This is a divisional of U.S. patent application Ser. No. 11/173,476 filed Jun. 30, 2005 and claims the benefit thereof under 35 U.S.C. §120, which application was a continuation of U.S. patent application Ser. No. 10/700,090 filed Nov. 3, 2003, which was a nonprovisional of U.S. Provisional Patent Application Number 60/423,436 filed Nov. 4, 2002. Each of U.S. patent application Ser. No. 11/173,476 filed Jun. 30, 2005, U.S. patent application Ser. No. 10/700,090 filed Nov. 3, 2003 and U.S. Provisional Patent Application No. 60/423,436 filed Nov. 4, 2002 is hereby incorporated by reference in its entirety into this divisional application.

FIELD OF THE INVENTION

The present invention relates generally to an attachment for a blade of a playing stick, particularly to an attachment for a blade of a hockey stick, and specifically to a blade of a hockey stick having a floor portion.

BACKGROUND OF THE INVENTION

A hockey stick is a structure that can hit an object, such as a hockey puck, with great force, with great control, and over a relatively great distance. For example, when hit by a hockey stick, a hockey puck can fly from one end to another end of a hockey rink at 100 mph or more precisely into a desired corner of the net.

Yard waste often includes undesirable refuse such as rotten hornet-infested crab apples and dog waste. Such refuse is undesirable for a number of reasons, including the consistency of the refuse such as its relative hardness or softness and the odor given off by the refuse. If the waste is being picked up by an apparatus, the apparatus may not have features permitting one to fling the waste to a desired spot such as a compost heap, and the apparatus may not have a sufficient length permitting a spacing of one from the waste. If the waste is being picked up by hand, one must bend down relatively close to the waste that may have an undesirable smell. If the waste is to be flung by hand to a desired location such as a compost heap, the waste may crumble upon the head of one who throws the waste.

SUMMARY OF THE INVENTION

A feature of the present invention is the provision in an attachment for a blade of a playing stick, of a base portion and a floor portion, where the base portion is engaged to the blade, where the floor portion extends from generally a lower edge of the blade, and where the floor portion includes a leading edge that can dig under an object to be picked up and flung by the playing stick.

Another feature of the present invention is the provision in such an attachment, of the base portion including at least one channel for engaging at least one of the upper and lower edges of the blade.

Another feature of the present invention is the provision in such an attachment, of the base portion including a pair of channels for engaging the upper and lower edges of the blade, and with the lower channel being greater in width than the upper channel such that the attachment is customized for a hockey stick.

Another feature of the present invention is the provision in such an attachment, of the floor portion tapering in the direction of the leading edge to provide a relatively narrow leading edge for digging under an object to be flung by the playing stick.

Another feature of the present invention is the provision in such an attachment, of the floor portion having a lower surface that is curved toward the leading edge.

Another feature of the present invention is the provision in such an attachment, of the floor portion being flexible between an L-shape and a V-shape relative to the blade such that an object can be cradled therein.

Another feature of the present invention is the provision in such an attachment, of the base portion and the floor portion being integral and one-piece.

Another feature of the present invention is the provision in such an attachment, of the attachment further include a ceiling portion spaced from the floor portion and extending generally from an upper edge of the blade in the same direction as the floor portion.

Another feature of the present invention is the provision in such an attachment, of the base portion including a finger that engages a heel end of the blade to maximize retention of the attachment on the blade when the playing stick is quickly swung.

Another feature of the present invention is the provision in such an attachment, of the floor portion having a seat for seating an object to be played by the playing stick.

Another feature of the present invention is the provision in such an attachment, of the leading edge of the floor portion having an undulating section.

Another feature of the present invention is the provision in such an attachment, of one of the base portion and floor portion having a slot for engaging a tether to be wrapped about the blade.

Another feature of the present invention is the provision in such an attachment, of one of the base portion and floor portion having a section for confronting a curved blade of a playing stick.

Another feature of the present invention is the provision in such an attachment, of the playing stick being a hockey stick.

Another feature of the present invention is the provision in an attachment for a stick, of a blade having a heel end for being engaged to a distal end of the stick, where the blade includes a floor portion, where the floor portion extends from generally a lower edge of the blade, and where the floor portion includes a leading edge that can dig under an object to be picked up and flung by the blade and stick.

Another feature of the present invention is the provision in a playing stick, of the playing stick having a blade, where the blade includes a floor portion, where the floor portion extends from generally a lower edge of the blade, and where the floor portion includes a leading edge that can dig under an object to be picked up and flung by the blade and stick.

An advantage of the present invention is that yard waste can be removed to a remote location without touching the yard waste, without bending down, and without smelling the yard waste at a close range.

Another advantage of the present invention is that yard waste can be removed to a remote location with great accuracy and over a great distance.

Another advantage of the present invention is that the present attachment, with no changes, may slide onto either a right-handed or left-handed playing stick.

Another advantage of the present invention is that the present attachment is inexpensive to manufacture.

Another advantage of the present invention is that the present attachment is relatively lightweight to minimize any change in the balance of the playing stick.

Another advantage of the present invention is that the attachment may be utilized on a number of playing sticks, including hockey sticks, lacrosse sticks, bandy sticks, and field hockey sticks.

Another advantage of the present invention is that the object to be played with is not limited to waste such as rotten apples and dog waste. These objects include tennis balls, plastic hockey pucks, conventional hockey pucks, street hockey pucks, rubber balls, bean bags, bean filled stuffed toys such as bean filled stuffed animals, hackey sacks, foam objects, and other objects.

Another advantage of the present attachment is a retention of the yard waste after the leading edge has been slipped under the yard waste. The retention is provided for by the curved lower surface of the floor portion that permits a pivoting motion of the attachment to draw the yard waste back into the attachment. The retention is further provided for by the floor portion being flexible relative to the base portion (or blade portion) such that a V-shape retainer is formed between the floor portion and the base portion (or blade portion).

IN THE DRAWINGS

DESCRIPTION OF THE PREFERRED EMBODIMENT

Figure 1:
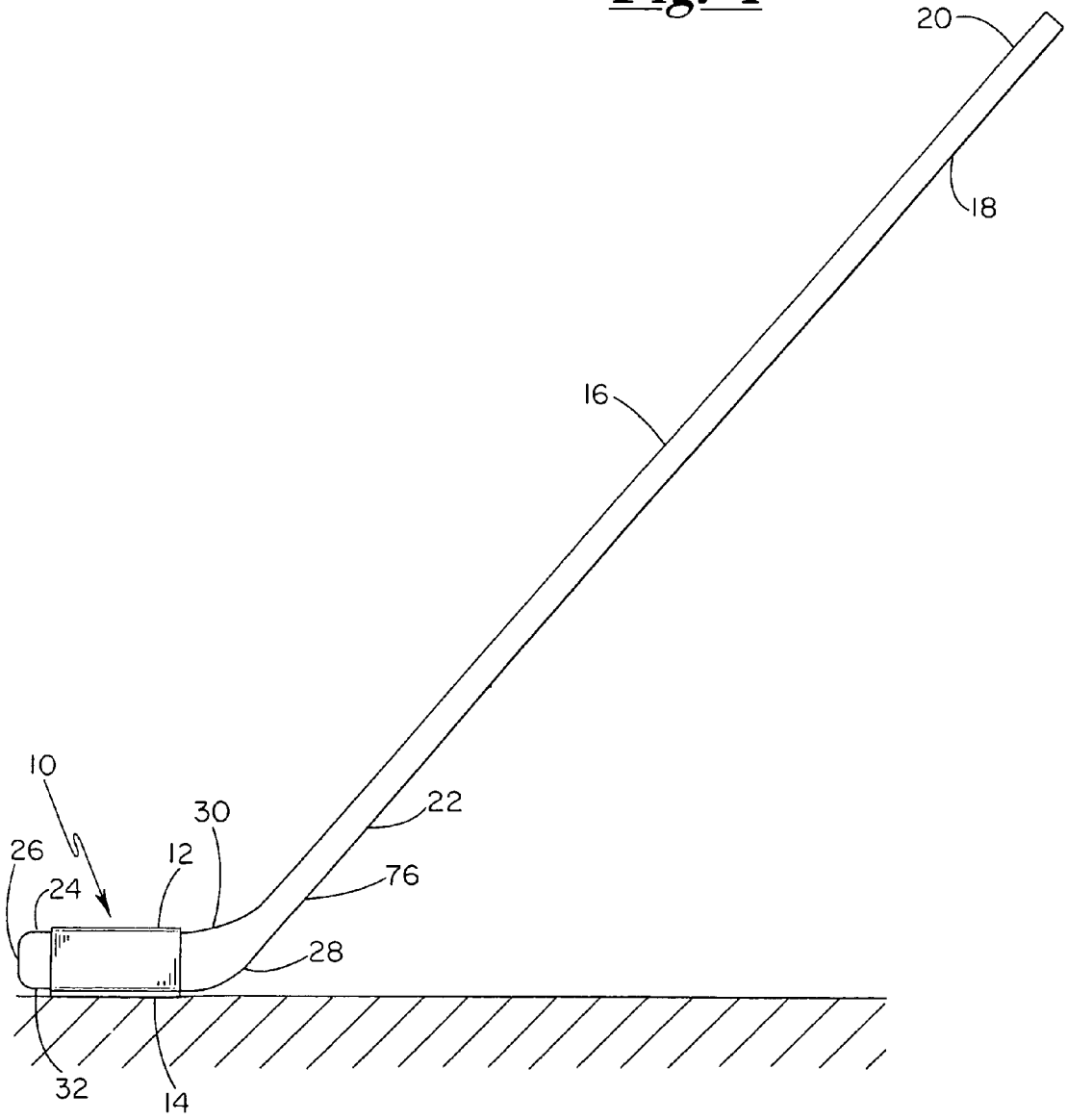
FIG. 1 shows a front view of a hockey stick and a front view of the present attachment on the hockey stick.

As shown in FIG. 1, the present invention is indicated in general by reference number 10. Attachment 10 includes a base portion 12 and a floor portion 14. Attachment 10 is engaged to a hockey stick 16. Hockey stick 16 includes a proximal end portion 18 that includes a handle 20. Hockey stick 16 further includes a distal end portion 22 that includes a blade 24. Blade 24 includes a toe end 26 and a heel end 28. Blade 24 further includes an upper edge 30 and a lower edge 32.

Figure 2:
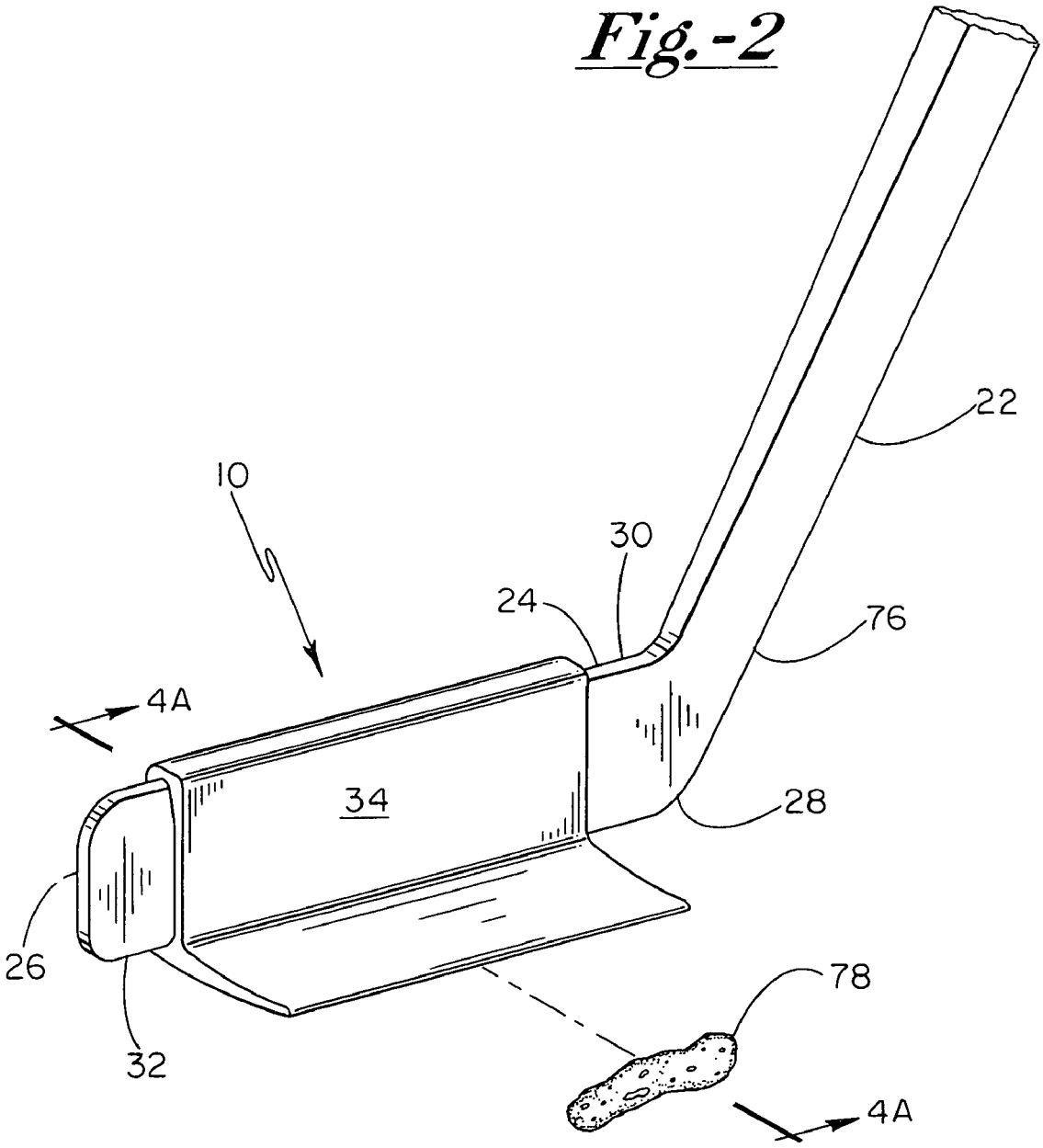
FIG. 2 is a detail perspective view of the attachment of FIG. 1.
Figure 3A:
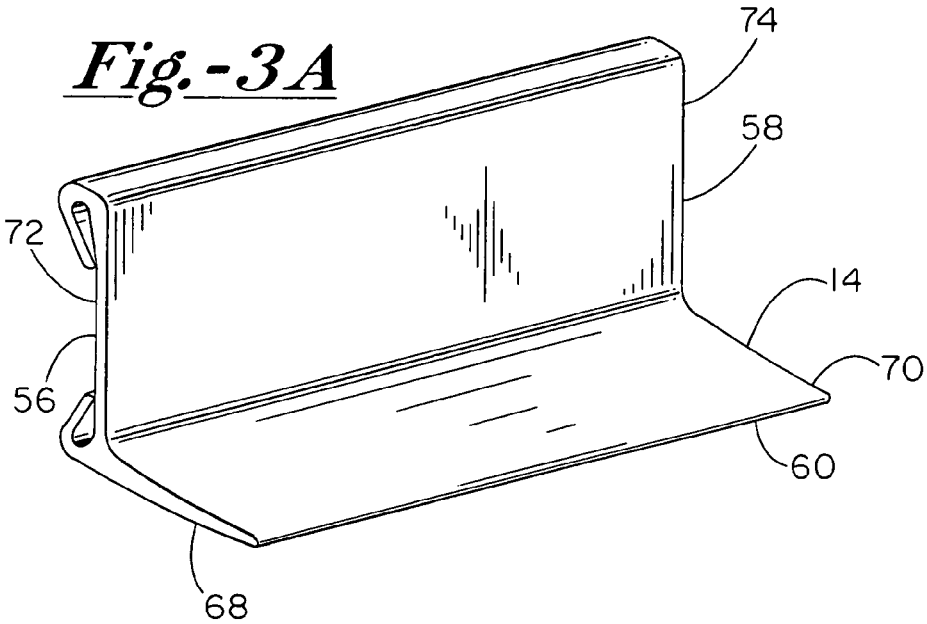
FIG. 3A is a detail perspective view of the attachment of FIG. 1 standing alone.
Figure 3B:
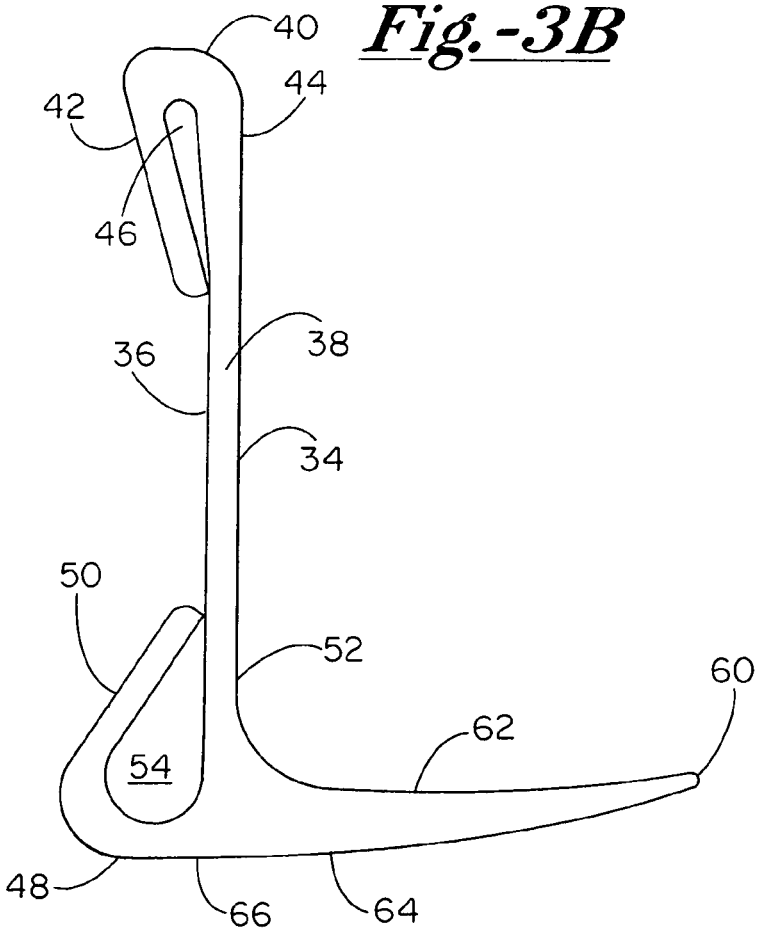
FIG. 3B is an end view of the attachment of FIG. 3A.

As shown in FIGS. 2, 3A and 3B, base portion 12 includes a first or front face 34, a second or rear face 36 that opposes the front face 34 and runs generally parallel to the front face 34. Front face 34 and rear face 36 define a blade section 38 of base portion 12. Blade section 38 runs generally parallel to the blade 24 of the hockey stick 16 when the attachment 10 is on the blade 24.

Base portion 12 further includes an upper grip 40 for engaging the upper edge 30 of the blade 24. The upper grip 40 includes a rear downwardly extending strip 42 further extending inwardly toward the rear face 36. The upper grip 40 further includes an upper strip 44 of the blade section 38. The strips 42 and 44 therebetween form a channel 46 for frictionally engaging the upper edge 30 of the blade 24.

Base portion 12 further includes a lower grip 48 for engaging the lower edge 32 of the blade 24. The lower grip 48 includes a rear upwardly extending strip 50 further extending inwardly toward the rear face 36. The lower grip 48 further includes a lower strip 52 of the blade section 38. The strips 50 and 52 therebetween form a channel 54 for frictionally engaging the lower edge 32 of the blade 24.

It can be appreciated that the lower channel 54 is of a relatively greater size than upper channel 46. In its preferred embodiment, the blade 24 is tapered so as to have a greater width or thickness at the lower edge 32 and so as to have a lesser width or thickness at the upper edge 30. The relative width or thickness of channels 46, 54 accommodates the standard hockey stick, and the inwardly projection of strips 42 and 50 accommodates other playing sticks having blades with front and rear faces that are parallel to each other (i.e., have only one width or thickness through the blade).

It can be appreciated that the blade of some hockey sticks have a toe end 26 that is greater in height than the heel end 28. In other words, the upper and lower edges 30 and 32 taper toward each other from the toe end 26 to the heel end 28. To permit the attachment 10 to slip onto the blade 24, and to retain the attachment 10 on the blade 24, grips 40 and 48 are sufficiently biased toward the inner face 36 to provide a strong friction grip. Further, it should be noted that, even if the toe end 26 is of a size too great for the height defined by the distance between the roots of the channels 46 and 54, the lower edge 32 of the blade can be set in lower channel 54 (with the upper edge 30 still outside of the attachment 10). Then the upper strip 42 can be lifted or peeled outwardly and upwardly away from the inner face 36 to permit the upper edge 30 to snap into the upper channel 46. This latter method can be utilized to place the attachment 10 on the blade 24 even if the toe end 26 is of a sufficient size to slide into one of the ends 56, 58 of the attachment 10.

Sliding the toe end 26 of the blade 24 into one of the ends 56, 58 is the preferred method for engaging the attachment 10 to the blade 24. Such a sliding urges an expansion of the channels 46, 54, whereupon the surfaces defining such channels 46, 54 frictionally engage the attachment 10 with a sufficient force that retains the attachment 10 on the blade 24 even when the hockey stick 10 is quickly swung.

Floor portion 14 includes a leading edge 60, an upper surface 62 and a lower surface 64. Surfaces 62, 64 taper toward each other from rear portions to front portions to form the relatively thin leading edge 60. Leading edge 60 is relatively thin to readily slip under objects. Lower surface 64 includes a curved shape to provide a pivoting action after an object has been picked up by the leading edge 60 such that the attachment 10 can be pivoted about a point 66 to draw the object back against the base portion 12 or blade section 38. Upper surface 62 is also curved to encourage a backward rolling of an object that has been picked up by the leading edge 60.

Floor portion 14 extends generally from the lower edge 32 of blade 24. When attachment 10 is on blade 24, a slightly space exists between the surface on which attachment 10 is resting and the lower edge 32 of the blade 24. Such a space does not exist in the embodiments shown in FIGS. 6A, 8A and 8B. Further, such a space may not exist when the embodiment of FIG. 6B is tethered to the blade 24.

As shown in FIG. 3A, leading edge 60 is straight and end edges 68 and 70 are straight. End edges 68, 70 lead into straight upright end edges 72 and 74, respectively, of the blade section 38.

Floor portion 14 may be referred to as a blade portion or a scoop portion. However, a scoop in a conventional sense includes a dish-like member and playing sticks conventionally have blades that are used to play and interact with an object. Accordingly, to avoid confusion, the term "floor" is used.

Figure 9:
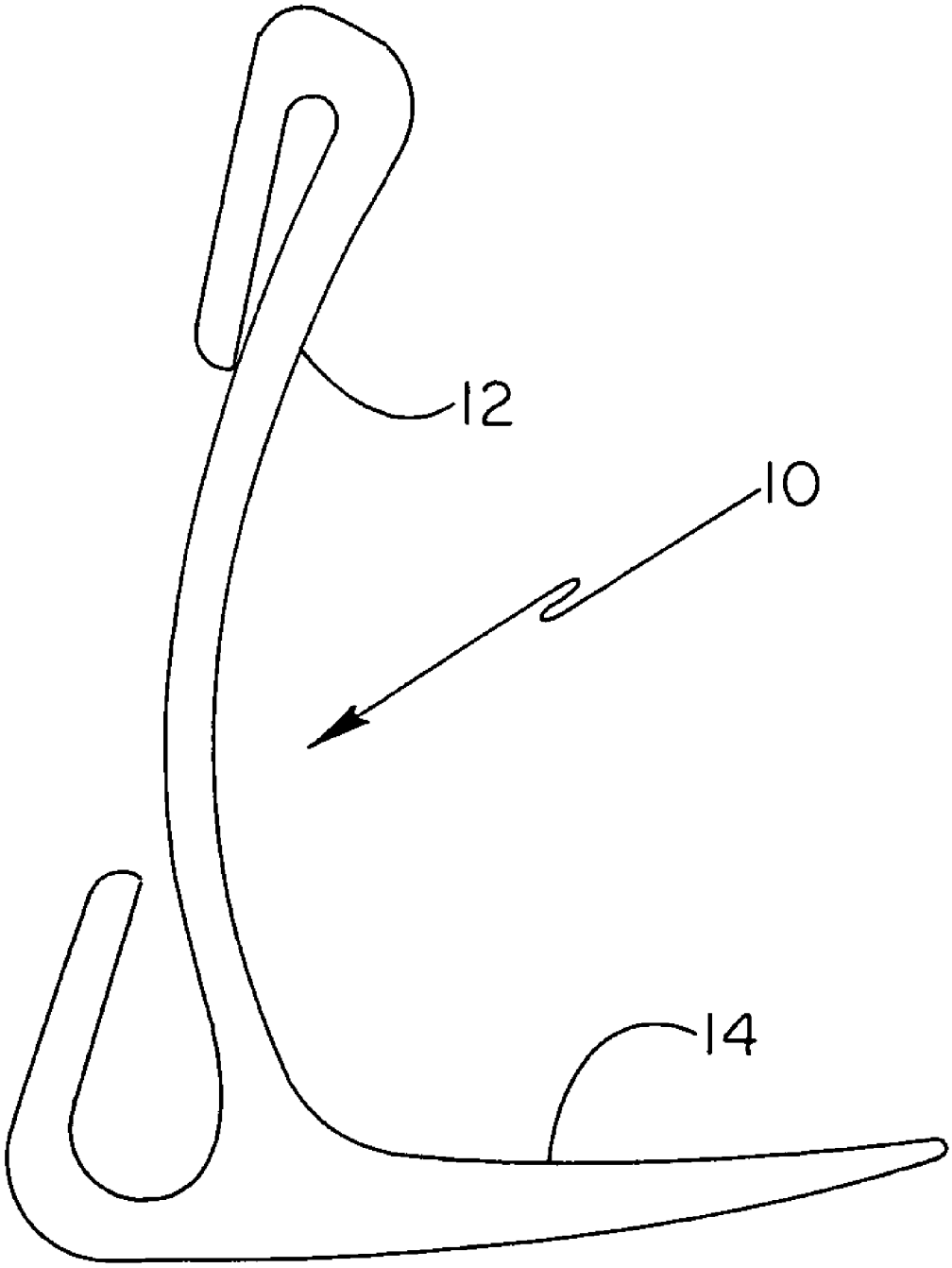
FIG. 9 shows an end view of the attachment of FIG. 3B when the attachment is extruded.

Attachment 10 is integral and one-piece. Attachment 10 may be molded or may be extruded. An extruded attachment 10 is shown in FIG. 9. Strip 42 is flexible, and preferably resilient, relative to blade section 38. Strip 50 is flexible, and preferably resilient, relative to blade section 38. Base section 38 is flexible, and preferably resilient, relative to floor portion 14 such that a general V-shape can be formed while an object is being picked up, with the V-shape being formed between the blade section 38 (or base portion 12) and the floor portion 14. In other words, in an unbiased form, the blade section 38 (or base portion 12) and the floor portion 14 form a general L-shape.

Figure 4A:
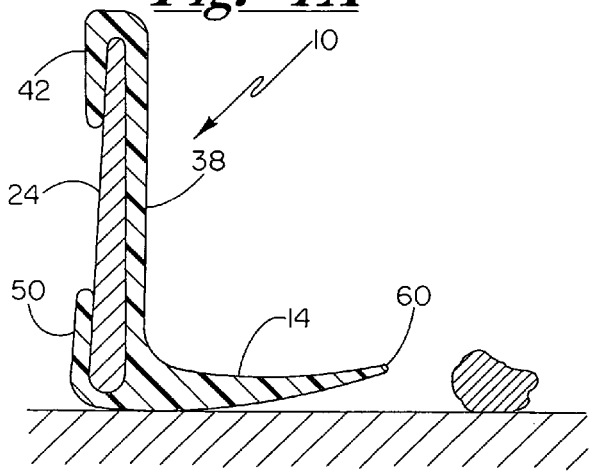
FIG. 4A is a section view of the present attachment at lines 4A-4A of FIG. 2 and shows an object to be picked up and flung.
Figure 4B:
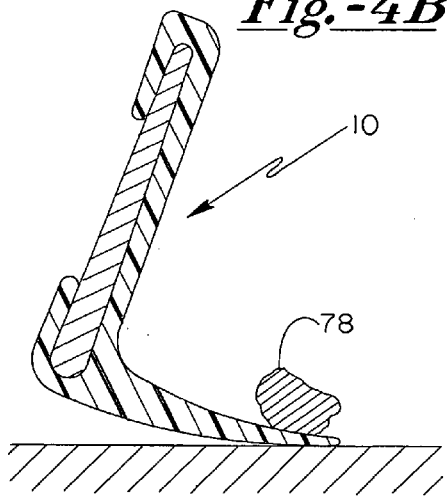
FIG. 4B is a section view similar to FIG. 4A and shows the leading edge of the attachment having picked up the object.
Figure 4C:
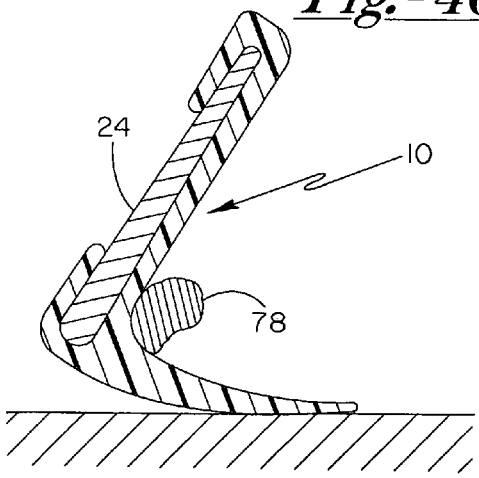
FIG. 4C is a section view similar to FIG. 4C and shows at least a section of the floor portion flexing into a V-shape arrangement with the base portion of the attachment so as to somewhat cradle the object immediately prior to the object being thrown by the playing stick.

However, where the floor portion 14 is being pressed against a surface, the floor portion 14 resiliently flexes toward the blade section 38 to form the general V-shape. It should be noted that one end portion of the attachment 10 (such as the toe end portion of the attachment 10) may form a general V-shape and the other end portion of the attachment 10 (such as the heel end portion) may form a general L-shape at the same time. FIG. 4B shows a general L-shape between the blade section 38 and the floor portion 14. FIG. 4C shows a general V-shape between the blade section 38 and the floor portion 14.

One preferred location of the attachment 10 on the blade 24 is a location such that the midpoint of the attachment 10 is closer to the toe end 26 than the heel end 28, where the heel end 28 of the blade 24 is defined by the point where the rear straight edge 76 of distal end portion 22 begins. The flinging of objects is better controlled with the attachment 10 being located relatively closely to the toe end 26.

FIGS. 2, 4A, 4B and 4C show an object 78 with which the hockey stick 16 can play. Object 78 as shown in FIG. 2, 4A, 4B, and 4C is intended to represent dog waste of an oblong shape. As indicated above, other objects include tennis balls, plastic hockey pucks, conventional hockey pucks, street hockey pucks, rubber balls, bean bags, bean filled stuffed toys such as bean filled stuffed animals, hackey sacks, and foam objects.

As further indicated above, stick 16 may be a hockey stick, a lacrosse stick, a bandy stick, or a field hockey stick.

In operation, the attachment 10 is first affixed to the blade 24 by slipping end 58 of attachment 10 onto toe end 26 of blade 24 if one is right-handed. (If one is a left-handed shooter, end 56 is slipped on toe end 26.) Or, as noted above, instead of slipping one of the ends 56, 58 onto toe end 26, one of the upper or lower edges 30, 32 may be placed into its respective channel 46, 54, with one of the strips 42, 50 then being resiliently flexed rearwardly and peeled over the remaining free edge 30 or 32. The attachment 10 if preferably fixed relatively closely to the toe end 26 for greater control in the flinging of object 78.

Then the leading edge 60 is slipped under the object 78, and the handle 20 is rotated so as to rotate the lower surface 64 relative to the surface where the object 78 was formerly resting such that the object may roll or slide rearwardly in the direction of the blade section 38. Then the floor portion 14 may be squeezed against the surface on which the object was formerly resting so as to form a general V-shape with the blade section 38 so as to cradle or even pinch the object 78, whereupon the handle 20 may be quickly swung to fling the object 78 to a remote location such as a compost heap. The operation may be repeated again and again so as to efficiently clean an area of waste, such as an area under a crab apple tree. The attachment 10 is readily cleaned with water or a mixture of soap and water since the surfaces of the attachment 10 are smooth. The attachment 10 may be removed from the blade 24 by sliding the attachment 10 off toe end 26 or by peeling back one of the strips 42, 50.

A hockey stick includes a stick and a blade set at an angle relative to each other. Such an angle is referred to as a lie. Lies range from four to eight. A goalie hockey stick uses a lie from 11 to 15. The length of the shaft (or stick portion) of the hockey stick is preferably between about 46 inches and about 62 inches. The blade is tapered so as to decrease in thickness in the direction from the lower edge to the upper edge, as shown in FIGS. 4A, 4B and 4C. Further, the lower edge of the blade is preferably rockered such that the lower edge is curved from the toe end to the heel end. Still further, the distal end portion of the stick tapers so as to decrease in width to flow smoothly into the relatively thin blade. As to a hockey stick, the following U.S. patents are hereby incorporated by reference:

1) the Tiitola U.S. Pat. No. 6,626,775 B2 issued Sep. 30, 2003 and entitled Method Of Manufacturing Blade Of Hockey Stick Or The Like, And Blade Of Stick And Blade Core; and 2) the Burger U.S. Pat. No. 6,224,505 B1 issued May 1, 2001 and entitled Hockey Stick Shaft.

Figure 5A:
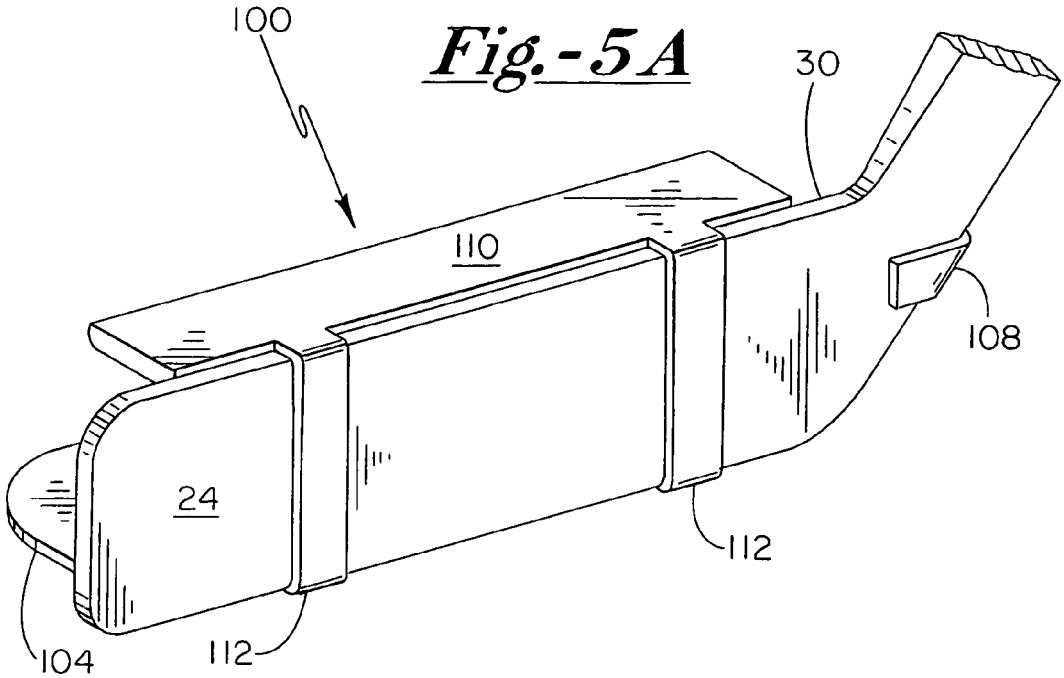
FIG. 5A shows a detail rear perspective view of an alternate embodiment of the invention.
Figure 5B:
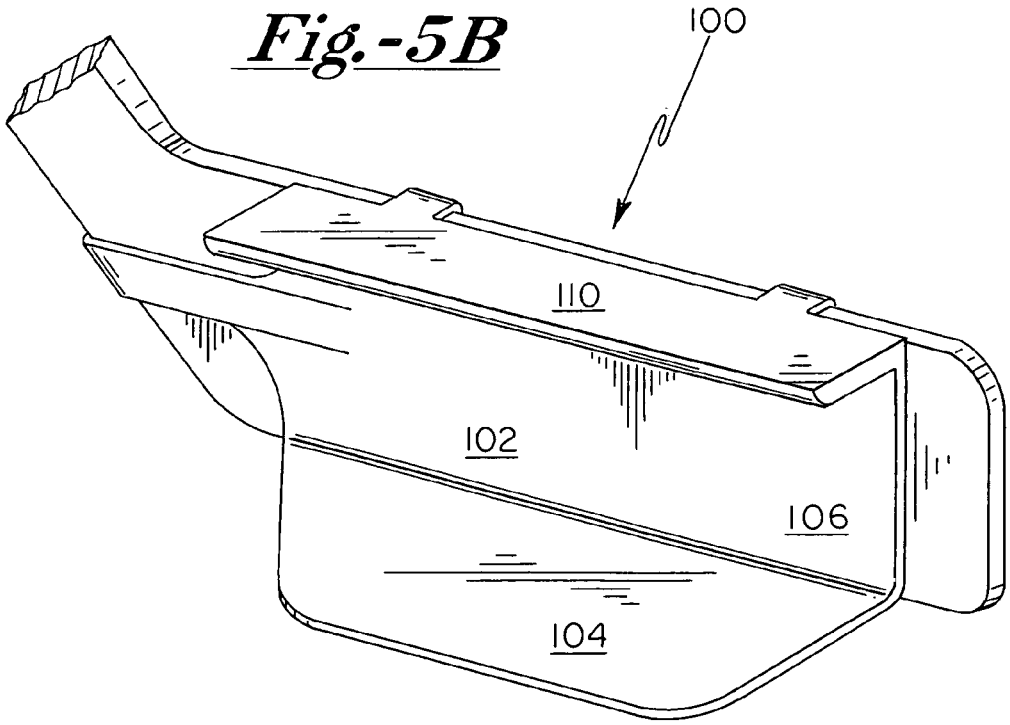
FIG. 5B shows a detail front perspective view of the attachment of FIG. 5A.

In an alternate embodiment of the invention, as shown in FIGS. 5A and 5B, an attachment 100 includes a base portion 102, a floor portion 104, a blade section 106, and an integral finger 108 extending rearwardly from the blade section 106 to engage the heel end or the blade 24 (or distal end portion 22 of the stick 16). Finger 108 maximizes retention of the attachment 100 on the blade 24 when the stick 16 is quickly swung. Attachment 100 further includes a ceiling portion 110 extending from the base portion 102 and extending generally from the upper edge 30 of blade 24. Ceiling portion 110 extends in the same direction as the floor portion 104 and is set in a plane generally parallel to the plane in which floor portion 104 lies. The base portion 102 includes a pair of integral loops or bands 112 extending about the rear of the blade section 106 for engaging, via a friction fit, blade 24. Attachment 100 is slid on and off of blade 24 via toe end 26. Ceiling portion 110 minimizes an upwardly unintended flinging of an object.

Figure 6A:
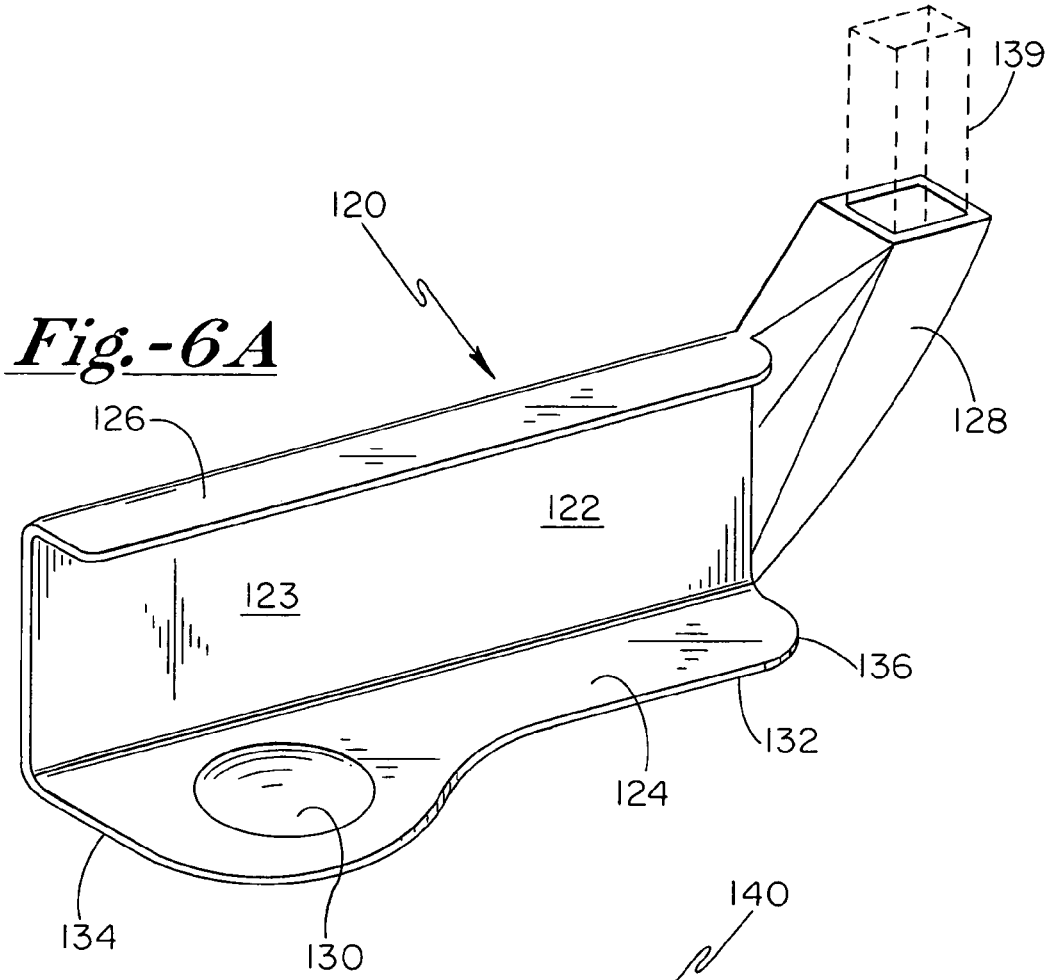
FIG. 6A shows a detail front perspective view of an alternate embodiment of the invention.
Figure 6B:
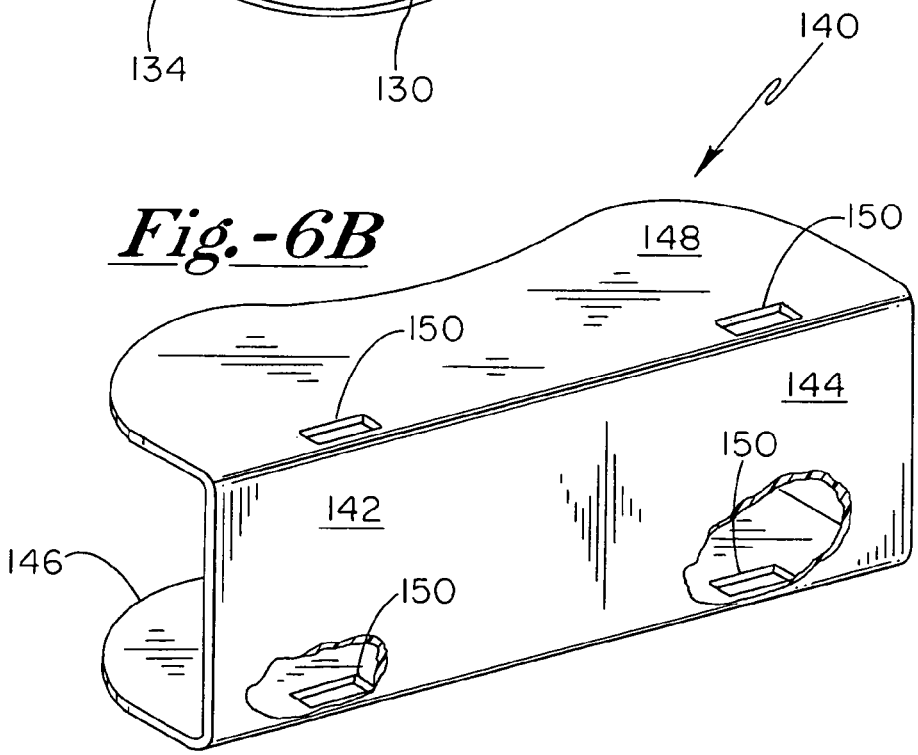
FIG. 6B shows a detail rear perspective view of an alternate embodiment of the invention.

In an alternate embodiment of the invention, as shown in FIG. 6A, an attachment 120 includes a base portion 122 having a blade section 123, a floor portion 124, a ceiling portion 126, a female receptacle 128 (or other type of engagement) and a seat or depression 130 formed in the floor portion 124. Ceiling portion 126 has a forward extending length less than the forwardly extending length of the floor portion 124. Floor portion 124 includes the seat 130 for minimizing a rolling of an object such as a tennis ball prior to the tennis ball being flung. Floor portion 124 further includes an undulating leading edge 132 such that a toe section 134 of the floor portion 124 is relatively large and such that a heel end 136 of the floor portion 124 is relatively small. The female receptacle 128 can fixedly receive therein the blunt distal end or distal end portion 22 of the hockey stick 16, or such engagement interacts with a hollow shaft as disclosed in the Burger U.S. Pat. No. 6,224,505 B1 issued May 1, 2001 and entitled Hockey Stick Shaft, which is hereby incorporated by reference, and where a blade may have a tenon (a male member) which is inserted into the shaft and where engagement is provided with a hot melt adhesive. Accordingly, instead of female receptacle 128, attachment 120 may include a tenon 139.

In an alternate embodiment of the invention, as shown in FIG. 6B, an attachment 140 includes a base portion 142 having a blade section 144, a floor portion 146, a ceiling portion 148, and a set of apertures 150 formed in the floor and ceiling portions 146, 148. Apertures 150 are formed as closely as possible to the blade section 144 and, if desired, may be formed in the blade section 144. Apertures 150 can receive tethers, such as nylon straps that can be drawn and locked to ever tighter loops, that can be wrapped about blade 24 so as to engage attachment 140 to hockey stick 16. It should be noted that ceiling portion 148 has an undulating leading edge.

Figure 7A:
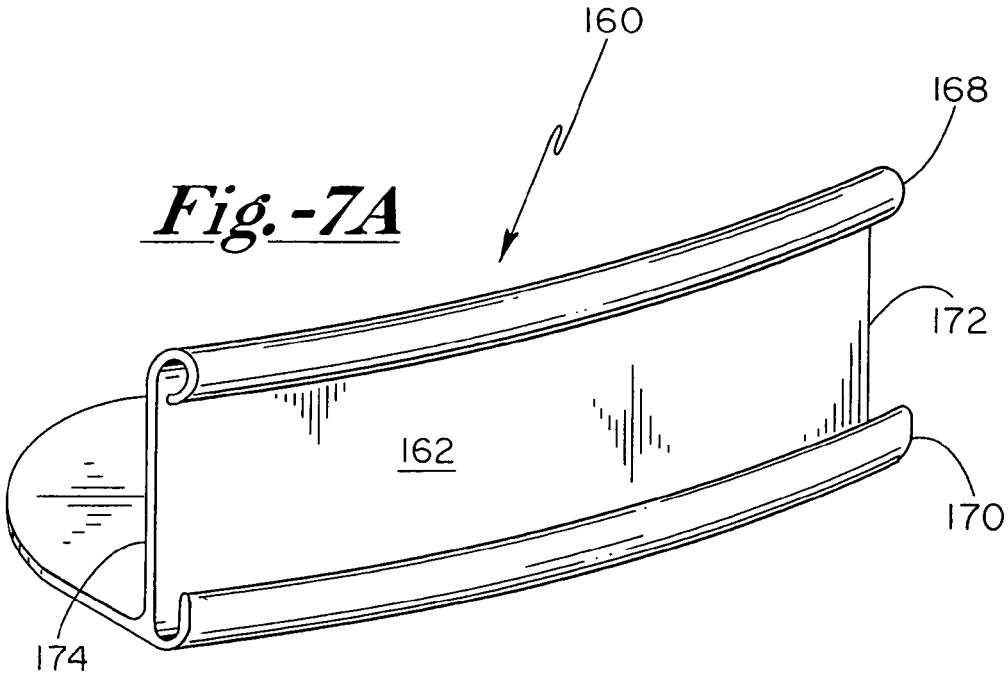
FIG. 7A shows a detail rear perspective view of an alternate embodiment of the invention.
Figure 7B:
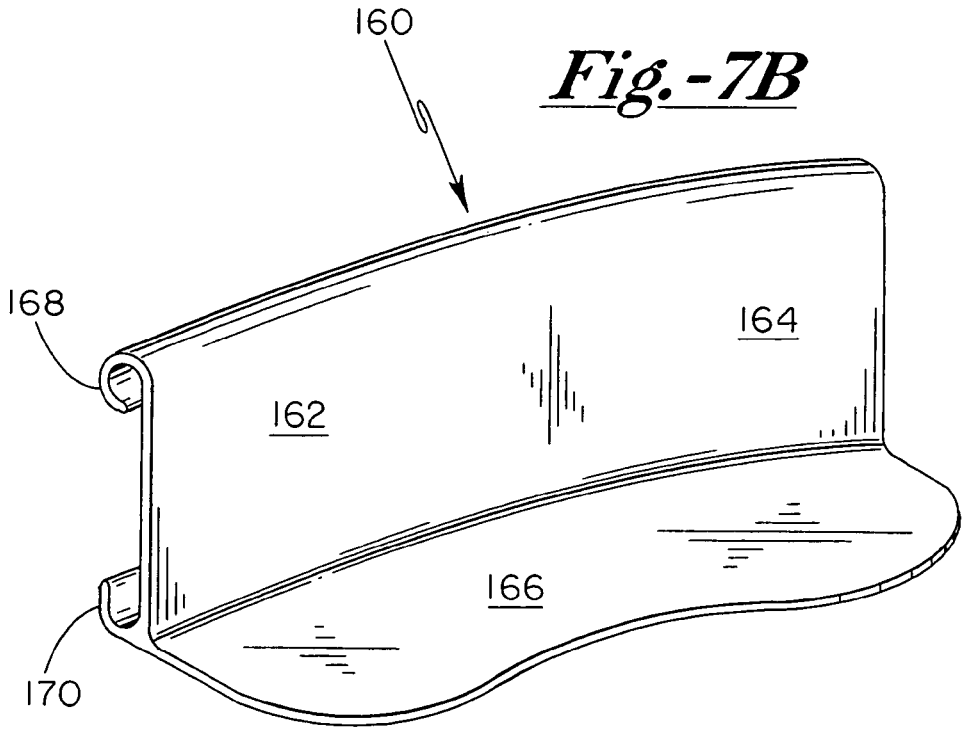
FIG. 7B shows a detail front perspective view of the embodiment of FIG. 7A.

In an alternate embodiment of the invention, as shown in FIGS. 7A and 7B, an attachment 160 includes a base portion 162 having a blade section 164, and a floor portion 166. Base portion 162 further includes means for fixing the attachment 160 to the blade 24 of the hockey stick 16, where such means includes upper and lower gripping resilient strips 168 and 170 for frictionally engaging the upper and lower edges 30, 32 of blade 24. Attachment 160 is the preferred attachment for a curved blade, as base portion 162, blade section 164, and gripping strips 168 and 170 are curved from one end 172 to the other end 174. However, it should be noted that, depending upon the type of plastic that is used for attachments 10, 100, 120, and 140, such attachments, if sufficiently flexible, can be used for curved blades as well. It should be noted that floor portion 166 has an undulating leading edge.

Figure 8A:
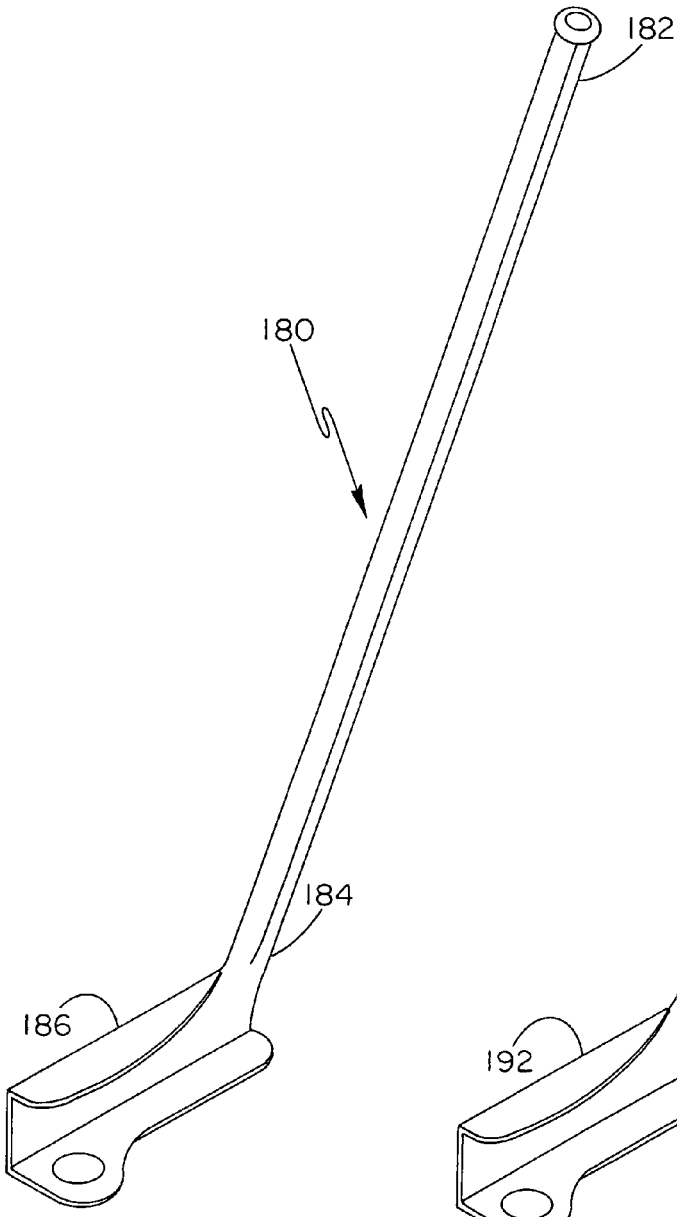
FIG. 8A shows a perspective view of an alternate embodiment of the invention.

In an alternate embodiment of the invention, as shown in FIG. 8A, a one-piece molded hockey stick 180 includes a handle portion 182, a distal end portion 184, a blade portion 186 having the features of attachment 120 except that female receptacle 128 is absent (i.e., blade portion 186 is one-piece and integral with distal end portion 184).

Figure 8B:
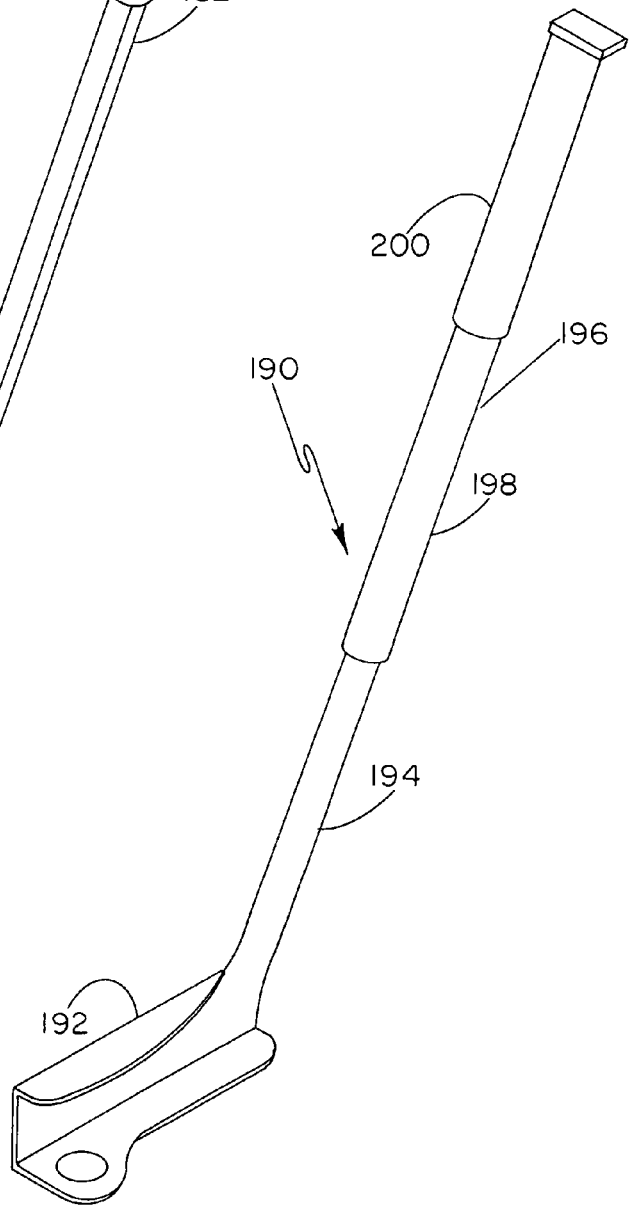
FIG. 8B shows a perspective view of an alternate embodiment of the invention.

In an alternate embodiment of the invention, as shown in FIG. 8B, a hockey stick 190 includes a blade portion 192 having the features of attachment 120 except that female receptacle 128 is absent (i.e., blade portion 192 is one-piece and integral with a distal end portion 194). Distal end portion 194 is one portion of a telescoping stick 196 that includes further telescoping sections 198 and 200. Stick 196 is extendable and retractable by sliding sections 194, 198 and 200 axially relative to each other.

It should be noted that preferably the above noted embodiments, including attachment 10, are preferably formed of a flexible or resilient plastic. If plastic, a preferred material is soft PVC, 90 durometer, with a smooth finish. Or the attachments may be formed of rubber or an elastomer or a plastic sold under the brand name Delrin or a polypropylene or a polypropylene that is talc filled. If desired, the attachments can be formed from or include metal and/or wood and/or composite materials. Further, while the floor portions of the attachments are relatively flexible and resilient, the floor portions are preferably also relatively rigid such that the leading edges can press down on the rear edge of an object and flip the object back onto the floor portion in the nature of the "tiddly winks" child game.

The length of the above noted attachments is preferably between about four and about nine inches, more preferably between about five and about eight inches, yet more preferably between about six and about seven inches.

One method of playing a game with the present novelty item is a distance and accuracy game or drill. Stretch a long string, a rope or a 100 foot tape measure along the ground in the middle of the longest part of your yard. Position yourself in line with the target and try to shoot your plastic poop down the length of the line. Using a shorter string, lay down a second line to the resting place of your plastic poop perpendicular to the main line and subtract that distance back towards where you originally shot from. Record the distance with a tape measure or stick serving as a marker. After three shots, add the distances up and the best total wins.

Another method of playing a game with the present novelty item is the following: position three targets in a yard and shoot your plastic poop towards each of the targets. Measure the distance from where your plastic poop landed to each of the targets and add the total. Low score wins.

Another method of playing a game with the present novelty item includes the setting of a pail out in the center of a yard and from three different locations, flick your plastic poop high into the air and try to land it in the pail. Add a predetermined amount (like 10, 25 or 50) to your point total for every "basket" made.

Another method of playing a game with the present novelty item includes giving each of the players (two players works best) their own plastic poop. Then pace of about ten steps apart along the border of a yard. Facing the far opposite border, walk briskly and pass the plastic poops back and forth to each other, such that the plastic poops cross at the same time. Reverse directions at the far border. Learn to "lead" the other player so momentum stays constant.

Another method of playing a game with the present novelty item accords long names (a handicap) to players with a relatively low skill level and short names (a handicap) to players with a relatively high skill level and directs players to negotiate such handicaps prior to the start of the game. For example, one preferred method of playing the game is that players must negotiate with other game participants, the name of a politician, e.g., Coleman, Dayton, Kennedy, Ventura, Clinton, or Bush. Over the course of the game, such name will be spelled out. Relatively highly skilled players may end up with short names such as Bush or Gore. Average skilled players may be accorded names like Clinton or Ventura. Novice players may be accorded a name like Stephenopolis to spell out before they are eliminated from play. This handicapping system allows people of varying skill levels to play fairly against one another and develops valuable negotiating skills among young children. At a challenging distance from a target, mark a spot for everyone in the game to shoot from. Use a hoop or lay an empty box or five gallon bucket on its side (or for more highly skilled players, stand the structure upright) for the goal and shoot the plastic poop at the target. The first player to make it in the goal gets to choose the next spot from which everyone will shoot. Those who miss have to spell the first letter of their assigned politicians (or handicaps). Each miss spells, or accumulates, another letter of the name (or handicap) until the name (or handicap) is completely spelled out, whereupon that player is eliminated from the competition. The game continues until there is only one player left that has not spelled out their full name (or handicap). Other names may used such as the names of pets, animal species, television news anchors, teachers or other handicaps that are not names (such as numbers) may be used.

Another method of playing a game with the present novelty item includes the step of finding three boxes, buckets or hoops of varying sizes. Designate the smallest target as the 100 point target, the medium size as the 50 point target and the largest as the 25 point target. The targets can be arranged "even across" (like a shooting gallery) or descending away with the most difficult target being the farthest away. Everyone takes turns shooting and adding up their own scores as the game progresses. The first player to reach 500 points wins.

Another method of playing a game with the present novelty item includes the use of a line such as a clothesline, upon which are engaged a number (such as three) of varying size pairs of underwear, bloomers or boxer shorts with respective varying point designations such as 25, 50 and 100 for larger, medium-sized, and small underwear, respectively, The first player to reach 500 points wins.

Another method of playing a game with the present novelty item includes setting up a number (such as nine) targets (e.g., pop cans, croquet hoops, boxes, bloomers) around a yard, public park or neighborhood. Design nine (or another number) of fairways that lead to the targets. Be sure to incorporate a number of dog legs, obstacles and hazards like cars, trees, flower beds, pools, fences, hedge rows, etc., that penalize players for inaccurate shots and aggressive play. Show respect to the property owners by taking care to use your plastic poop in a responsible fashion. Each player must drop their plastic poop at the same starting point of each hole and keep track of the number of times they shoot the plastic poop on the way to touching the target with their plastic poop. Score cards are recommended as scores can exceed 50 points on the more difficult course layouts. One stroke penalties should be assessed to anyone who has to move the plastic poop away from a hazard in order to have a clear shot. The plastic poop may be moved no more than one stick length away from the hazard and at a location no closer to the hole (or target). Swings in the fashion of a golf swing are not allowed. A hockey style wrist shot provides the best results. Low score wins.

Another method of playing a game with the present novelty item includes finding a ball, such as a golf ball or tennis ball in the garage. Toss is out in the yard at a challenging but reachable distance for everyone in the game.

All participants must drop their plastic poop in the same spot and take turns shooting at the ball in the yard. The plastic poop that ends up closest to the ball earns three points, second gets two points and third closest gets one point. The ball is then tossed in another direction for the next point scoring round. Hand placing the ball in difficult positions is acceptable if all parties agree. Stay away from fragile plants and flowers, windows, nesting water fowl and dangerous situations, rivers, lakes and swamps. The first person or two person team to reach 21 points wins the game.

Another method of playing a game with the present novelty item requires a relatively large number of players (at least six per team) where each of the teams may have the same number of players. Each of the players has his or her own plastic poop. The game is played on a relatively large playing field with two goals on either end, in the nature of a soccer field or an unflooded hockey rink. While lacrosse is played from the waist up with nets on sticks, the present game is played from the waist down. Goalies should wear protective face masks and use a baseball glove or a fishing net. One part of the game is negotiation of the rules, which may be a combination of rules using soccer, hockey and lacrosse rules as a guideline. Boundaries, off-sides, penalties, and scoring systems can be negotiated. Play may begin with a face-off at the center of the playing field. Time limits or point limits may be used to determine when the game ends. Slap shots may be outlawed.

Another method of playing a game begins with the formation of two teams along opposing boundaries of the yard. Each of the players has his or her own plastic playing piece. Team-mates space themselves at a safe distance from one another and being launching their playing piece at the team formed on the other side of the yard, who must try to dodge the playing pieces that are being hit at them. If a player is hit by a flying plastic piece, the player is eliminated from the game and must vacate the playing field. Players willing to risk getting hit can move about the center of the yard as they please, retrieving and flinging plastic playing pieces at the other side. The winning team is the team that eliminates the last remaining player of the opposing team. Plastic playing pieces for this game may include the plastic poop piece, beanie bags, beanie bag dolls or stuffed animals, tennis balls, and water balloons.

Another method of playing a game with the present invention requires each of the players to have a plastic playing piece. A large circle of players is formed around a single player, who is designated a certain character, such as the burglar. The object of the game is to pass a playing piece across the middle of the circle past the person in the middle (the burglar). Players forming the circle must catch or trap the plastic playing piece and then hit or fire it back across the middle of the circle as fast as possible. The burglar must make every attempt to steal the plastic piece as the plastic pieces are shot back and forth across the circle. The burglar is relieved from being the burglar upon catching a player's plastic playing piece, whereupon such player must replace the burglar and thereby become the new burglar, i.e., the player in the middle of the circle. The game may be slightly changed by requiring every player to take a turn in the middle of the circle, whereupon the winner of the game may be the player who captures the greatest amount of plastic pieces while serving his or her turn as the burglar.

Another method of playing a game includes the step of finding ten plastic bottles of identical size, filling them up partially with water, such as about one-third full, arranging the bottles like a full set of bowling pins on a hard surface, and setting an elongate piece of plastic in the nature of a bowling lane in front of and leading to the bottles. Then playing pieces, such as plastic poop, or bean bags, or beanie dolls, or beanie animals may be slidingly pushed or slidingly hit a relatively great distance along the elongate piece of plastic and into the bottles in an attempt to knock down the bottles. Each of the players gets two tries in succession before his or her turn is over. After ten rotations or turns, the game is over. Score is kept by counting the number of fallen bottles after two tries. A perfect score would be 100.

What is claimed is:

1. A play apparatus comprising:

a) a stick comprising a handle end and a distal end spaced from the handle end;

b) a first blade comprising a toe end, a heel end, an upper edge, a lower edge, a first face, and a second face, with the heel end being engaged to the distal end of the stick;

c) a floor portion extending from the lower edge of the first blade and having a leading edge adapted for digging under an object with which the play apparatus plays;

d) wherein the play apparatus is a hockey stick;

e) wherein the distal end of the stick is one-piece and integral with the first blade;

f) wherein the floor portion is flexible between an L-shape and a V-shape relative to the first blade such that the object may be cradled therein; and g) wherein the floor portion is a second blade.

2. The play apparatus of claim 1, wherein the stick is extendable and retractable relative to the first blade.

3. The play apparatus of claim 1, wherein the play apparatus, including the stick, first blade and floor portion, is one-piece and molded.

4. The play apparatus of claim 1, wherein the play apparatus, including the stick, first blade and floor portion, is a one-piece molded hockey stick.

5. The play apparatus of claim 1, wherein the stick includes telescoping sections.

6. A play apparatus comprising:

a) a stick comprising a handle end and a distal end spaced from the handle end;

b) a first blade comprising a toe end, a heel end, an upper edge, a lower edge, a first face, and a second face, with the heel end being engaged to the distal end of the stick;

c) a floor portion extending from the lower edge of the first blade and having a leading edge adapted for digging under an object with which the play apparatus plays;

d) wherein the play apparatus is a hockey stick;

e) wherein the distal end of the stick is one-piece and integral with the first blade; and f) wherein the floor portion is flexible between an L-shape and a V-shape relative to the first blade such that the object may be cradled therein.

* * * * *